United States Patent [19]

Benedyk et al.

[11] 4,425,393

[45] Jan. 10, 1984

[54] LOW MODULUS, SMALL DIAMETER FIBERS AND PRODUCTS MADE THEREFROM

[75] Inventors: Joseph C. Benedyk, Highland Park, Ill.; William McGlone, Conifer, Colo.; Homer Amos, Palm Springs, Calif.

[73] Assignee: Brunswick Corporation, Skokie, Ill.

[21] Appl. No.: 317,885

[22] Filed: Nov. 3, 1981

Related U.S. Application Data

[63] Continuation-in-part of Ser. No. 33,481, Apr. 26, 1979, abandoned.

[51] Int. Cl.[3] ..... B32B 3/02

[52] U.S. Cl. ..... 428/95; 57/243; 57/246; 428/85; 428/87; 428/97; 428/233; 428/253; 428/364; 428/365; 428/392; 428/398; 428/401; 428/921

[58] Field of Search ..... 428/85, 92, 233, 253, 428/364, 365, 392, 398, 401, 97, 921, 87, 95, 921; 57/243, 246

[56] References Cited

U.S. PATENT DOCUMENTS

| | | | |
|---|---|---|---|
| 3,256,258 | 6/1966 | Herrman | 526/348.1 |
| 3,424,833 | 1/1969 | Mazzolini et al. | 428/364 |
| 3,546,062 | 12/1970 | Herrman | 526/348.1 |
| 3,605,666 | 9/1971 | Kimmel et al. | 28/109 |
| 3,686,848 | 8/1972 | Miller et al. | 264/168 |
| 3,840,510 | 10/1974 | Rohn | 526/348.1 |
| 4,118,530 | 10/1978 | Benedyk et al. | 428/97 |
| 4,181,762 | 1/1980 | Benedyk | 428/364 |

*Primary Examiner*—James J. Bell

*Attorney, Agent, or Firm*—Fidelman, Wolffe & Waldron

[57] ABSTRACT

A remarkable degree of softness and flexibility is imparted to products such as artificial fur, soft woven or knitted fabrics and the like by using relatively small diameter fibers having a low elastic modulus. The fiber diameter and elastic modulus are selected to obtain a stiffness parameter of less than $8.5\times10^{-9}$ but preferably greater than $1.0\times10^{-11}$ lb-in$^2$.

27 Claims, 6 Drawing Figures

LOW MODULUS, SMALL DIAMETER FIBERS AND PRODUCTS MADE THEREFROM

This application is a continuation-in-part of applicants' copending application, Ser. No. 033,481, filed Apr. 26, 1979, of the same title as the instant application, and now abandoned.

CROSS-REFERENCES TO RELATED APPLICATIONS

This application is related to the copending application Ser. No. 17,465 of Joseph C. Benedyk, entitled "Fibers, Yarns and Fabrics of Low Modulus Polymer," now U.S. Pat. No. 4,181,762.

BACKGROUND OF THE INVENTION

This invention relates generally to the production of small diameter monofilament fibers from low modulus polymeric materials and to yarns, fabrics, furs and other products made therefrom.

More specifically, this invention relates to fibers having a combination of physical properties which impart a unique degree of softness and flexibility to the products made therefrom.

Historically, man-made fibers have been engineered so that the physical properties of such fibers are about the same as textile fibers found in nature, for example, cotton or wool. Natural textile fibers are generally thin, having a diameter less than about 2 mils and a high elastic modulus, for example, a modulus greater than about 200,000 psi. Thus, synthetic fibers are thin and have a high modulus. For example, a typical commercially-available, polyethylene monofilament having a tensile strength of about 28,500 psi displays an elastic modulus of about 340,000 psi. Such thin, high modulus fibers have a stiffness parameter generally ranging between about $1\times10^{-5}$ and about $1\times10^{-8}$ lb-in$^2$. In general, any fiber having a stiffness parameter within this range will feel soft and pliant. Because conventional fibers have a relatively high elastic modulus, usually well above 200,000 psi, they must have a relatively low moment of inertia. Otherwise they would feel too stiff.

Elastic modulus, designated as $E_f$, is determined by measuring the initial slope of the stress-strain curve derived according to ASTM standard method No. D2256-69. Strain measurements are corrected for gauge length variations by the method described in an article entitled "A Method for Determining Tensile Strains and Elastic Modulus of Metallic Filaments", ASM Transactions Quarterly, Vol. 60, No. 4, December 1967, pp. 726–27.

The moment of inertia, designated $I_f$, of a fiber is a function of its cross-sectional area. Under normal loading conditions, fibers bend about a neutral axis where the moment of inertia will be a minimum value. The moment of inertia about this neutral axis is calculated using the following equation:

$$I_f=\int y^2 dA$$

where dA is any incremental area of the fiber's cross-section and y is the distance any such incremental area is from the neutral axis.

For fibers with a uniform circular cross-sectional configuration, the moment of inertia ($I_f$) may be calculated by the following formula:

$$I_f=\pi d^4/64$$

where d is the fiber diameter. Specific equations for calculating the moments of inertia of fibers having a cross-sectional configuration other than circular are given in a paper presented at the 47th annual meeting of the ASTM, Vol. 44, (1944).

The stiffness parameter of a fiber, designated $K_f$, is a general indicator of the feel, or hand, of a fabric made from that fiber. This stiffness parameter is the product of the elastic modulus of the fiber and the area moment of inertia of the fiber:

$$K_f=E_f\times I_f$$

When considering the hand of any fiber, one must take into account the specific textile construction in which the hand is being judged. In a fabric of pile construction, for example, the fiber acts under loads like an upright column wherein the load to affect unit strain in bending is defined by the formula:

$$F=E_fI_f/I^2$$

where I is the pile height. Normally, pile height is established by styling considerations. Thus, the stiffness parameter, $K_f$, is a basic measure of the softness or degree of flexibility of a fabric. In general terms, one may compare the hand of different fabrics by comparing the stiffness parameter of the fibers provided that each fiber has a uniform cross-section and is composed of the same material throughout.

DISCUSSION OF THE PRIOR ART

A number of thermoplastic polymeric materials having an elastic modulus in the range of 2,000 to 100,000 psi are known and are commercially available. Examples of such known and commercially available polymers include ethylene-vinyl acetate copolymers, plasticized polyvinyl chloride, low density polyethylene, ethylene-ethyl acrylate copolymer, ethylene-butylene copolymer, polybutylene and various copolymers thereof, certain ethylene-propylene copolymers, chlorinated polypropylene, chlorinated polybutylene and various compatible mixtures of these thermoplastics. However, the prior art has consistently viewed these polymers as unsuitable for use in fibers precisely because of their low elastic modulus and also because of their uniformly low tensile strength.

It is also known to produce elastometric fibers from various rubbery polymers as, for example, spandex which comprises a synthetic polymer of a segmented polyurethane. Elastometric fibers comprising an ethylene-vinyl acetate copolymer are also known as is disclosed in German Patent No. 1,278,689. Copolymers used have a vinyl acetate content of 40 to 45% and fibers are spun from a solution of the polymer in a solvent such as methylene chloride. Elastic modulus of the fibers produced by the process of the German patent is about 0.08–0.09 Kp/mm$^2$ which, in English units, is about 120–130 lb/in$^2$.

Techniques to form fiber into yarn and to manufacture pile fabrics from yarn are, of course, well known. Exemplary patents illustrating these techniques include U.S. Pat. Nos. 3,605,666 and 3,686,848. Long pile fabrics simulating animal fur are also well known.

SUMMARY OF THE INVENTION

We have found that fibers suitable for use in making extremely soft and flexible knitted and woven fabrics and simulated fine fur may be manufactured of polymeric materials heretofore considered completely unsuited to such use provided that certain criteria are met. The elastic modulus of the polymeric material must be in the range of 2,000 to 100,000 psi, and more preferably in the range of about 5,000 to 50,000 psi and the combination of elastic modulus and fiber diameter must be selected so as to provide a fiber stiffness parameter of less than $8.5\times10^{-9}$ lb-in$^2$. Individual fibers, which may be produced in monofilament form by extrusion through an orifice, will typically have a diameter ranging from about 0.5 to 3 mils. The fibers may be formed into yarn in conventional fashion and the yarn used to produce very soft knitted and woven fabrics. For other uses such as in doll hair, simulated animal fur and the like, the fibers may be used in monofilament form without first spinning or twisting into yarn.

Hence, it is an object of our invention to produce fibers having properties uniquely suited for use in the manufacture of very soft fabrics.

It is a further object of our invention to provide yarns of those fibers and to manufacture soft knitted and woven fabrics therefrom.

Another object of our invention is to provide long pile fabrics simulating fine animal fur.

GENERAL DISCUSSION OF THE INVENTION

Man-made fibers such as the nylons, acrylics, polyesters and the like display an elastic modulus ranging generally from about 200,000 to 2,000,000 psi which conforms generally to the elastic modulus range of natural fibers. Consequently, attempts to produce fibers which display a high degree of softness and flexibility when formed into a fabric required the production of extremely fine fibers. Because the difficulty and expense of manufacturing fibers increases sharply as fiber diameter decreases, this approach has been self-limiting.

The art has failed to recognize that extreme fiber softness and flexibility can be attained at moderate fiber diameters by utilizing polymeric materials having what has traditionally be considered to be an unacceptably low elastic modulus. Rather, the search for alternatives to natural fibers and the more expensive synthetic fibers has focused almost exclusively on attempts to duplicate, or substantially duplicate the properties of those fibers, i.e., high elastic modulus and high tensile strength. We concentrated instead on the properties desired in the manufactured fabric and set the physical parameters of the fiber to achieve the desired fabric properties.

Specifically, we have found that fabrics having remarkable softness and flexibility can be produced from fibers manufactured from a polymer having a low elastic modulus provided that the fiber diameter selected is such that the fiber stiffness parameter is less than $8.5\times10^{-9}$ lb-in$^2$.

The chief criterion for selecting a polymeric material for use in our invention is its elastic modulus. The best material discovered so far is an ethylene-vinyl acetate copolymer having a vinyl acetate content ranging from about 1 to about 20 percent by weight and a melt index of from about 0.5 to about 9. This material will provide the monofilament with the desired elastic modulus and is also relatively inexpensive. The following are examples of other thermoplastic materials which will provide the monofilament with an elastic modulus within the range of from 2,000 to 100,000 psi: (a) plasticized polyvinyl chloride, (b) low densign polyethylene, (c) thermoplastic rubber, (d) ethylene-ethyl acrylate copolymer, (e) ethylene-butylene copolymer, (f) polybutylene and copolymers thereof, (g) ethylene-propylene copolymers, (h) chlorinated polypropylene, (i) chlorinated polybutylene, or (j) mixtures of these thermoplastics.

Although the ethylene-vinyl acetate copolymer has the desired elastic modulus, one problem with this material is that it has a relatively low melting point. To obviate this problem and increase the heat resistance of the fiber, the molecules of the copolymer may be cross-linked. Cross-linking may be achieved either during or after manufacture of the fiber. Conventional irradiation techniques may be employed or the molecules of the polymer may include moieties which react under selected conditions with other molecules to effect cross-linking. Only partial cross-linking is desired so that the material retains the required elastic properties. Ordinarily, cross-linking increases the melting point of the material so that it is 200° F. or greater.

As has been stated previously, the polymeric materials suitable for use in our invention have an elastic modulus in the range of about 2,000 to 100,000 psi. Consequently, to display the required stiffness parameter of less than $8.5\times10^{-9}$ lb-in$^2$ the fiber diameter must be less than about 3–4 mils and preferably in the range of about 0.5 to 3 mils. In terms of denier, the fiber would have a denier ranging from about 5 to 35 for polymers having a specific gravity in the range of about 0.9 to 1.4.

DETAILED DESCRIPTION OF THE INVENTION

Figure 1:
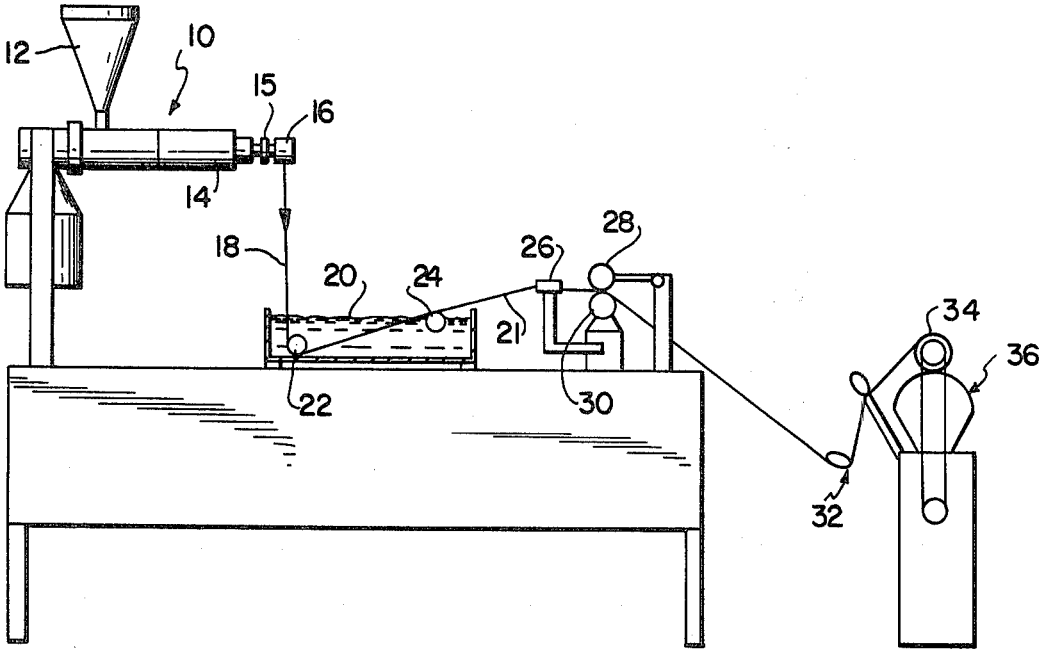
FIG. 1 is a side elevational view of an extruder and draw-line used in spinning the fiber of our invention.

Referring first to FIG. 1, there is shown a preferred method of making the fibers of our invention. Polymeric material having the proper elastic modulus is extruded into a plurality of monofilaments using a conventional extruder 10 as is described in a paper presented by D. Poller and O. L. Riedy, "Effect of Monofilament Die Characteristics on Processability and Extrudate Quality", 20th Annual SPE Conference, 1964, paper XXII-2. Extruder 10 includes a hopper 12 into which pellets of polymeric material are deposited, an extruder barrel 14 where the pellets are melted, a static mixer 15, and a spinnerette plate 16 through which the molten polymeric material is forced.

The melted polymeric material leaves the spinnerette plate 16 as a plurality of of molten strands 18 of polymer which continuously flow downwardly into a water bath 20 maintained at a temperature in the range of ambient to about 150° F. When the molten polymer strands strike the water in the bath 20, they are chilled rapidly and become a continuous solid monofilament fiber 21. This fiber passes around a pair of guides 22 and 24 and through a guide plate 26 into the nip of a pair of rollers 28 and 30. These rollers 28 and 30 pull on the fiber to draw the molten polymer strands 18 so that each strand has a diameter of about 1 to about 5 mils and preferably from about 2 to 4 mils. On leaving the rollers 28 and 30, the solid monofilaments pass through a fiber guide/-braking system 32 and are wrapped about spools 34 mounted on a winder 36.

Figure 1A:
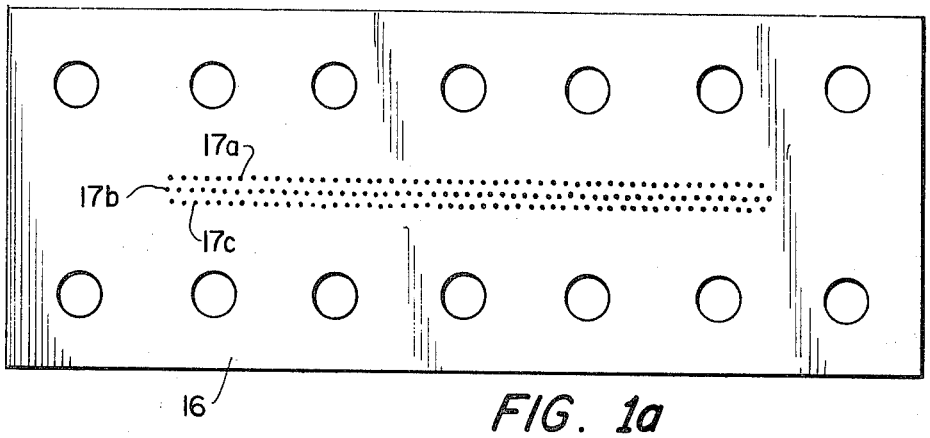
FIG. 1*a* is a front elevational view of the spinnerette plate.
Figure 1B:
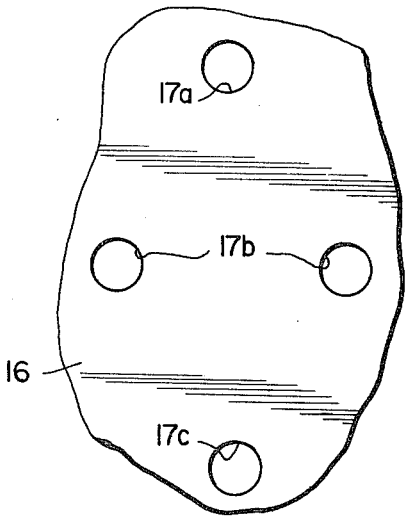
FIG. 1*b* is an enlarged fragmentary view of the orifices in the spinnerette plate.

FIG. 1*a* illustrates in detail spinnerette plate 16 which may include three rows 17*a*, 17*b*, and 17*c* of aligned orifices or holes. For extruding monofilaments to form the fibers of my invention, the orifices preferably have a diameter in the range of about 2 to 6 mils. As shown in FIG. 1*b*, the holes making up the central row 17*b* are offset at an angle of about 60° with respect to the holes in top and bottom rows 17*a* and 17*c*. The spacings between the top row 17*a* and the center row 17*b* and the bottom row 17*c* are each approximately 0.065 inch. The spacing between adjacent holes in any one row is approximately 0.075 inch. The holes may be straight or tapered at an angle of approximately 15° to 30°.

Figure 2:
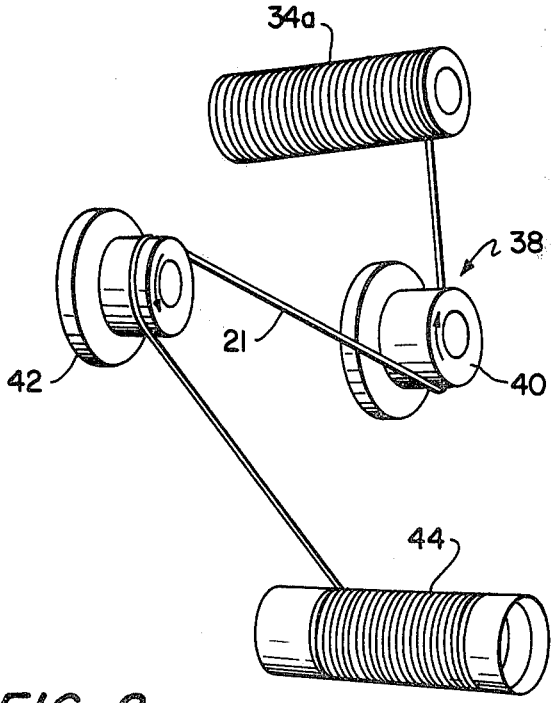
FIG. 2 is a conventional draw-winding apparatus for drawing or stretching the fiber at temperatures below 100° F.

Turning now to FIG. 2, there is shown the drawing of monofilaments in the solid state. This solid state drawing is performed at a temperature below about 100° F. and reduces the diameter of the extruded monofilaments from about 1 to 5 mils to about 0.5 to 3 mils. A spool 34*a*, loded with multiple strands of monofilament is removed from the winder 36 of FIG. 1 and placed on the draw winding apparatus 38 shown in FIG. 2. The lead ends of the fibers 21 on the spool 34*a* are unwound, guided about two drawing godets 40 and 42, and wrapped around a second spool 44. These godets 40 and 42 turn at different angular velocities so the fibers 21 coming off the spool 34*a* are stretched.

Figure 3:
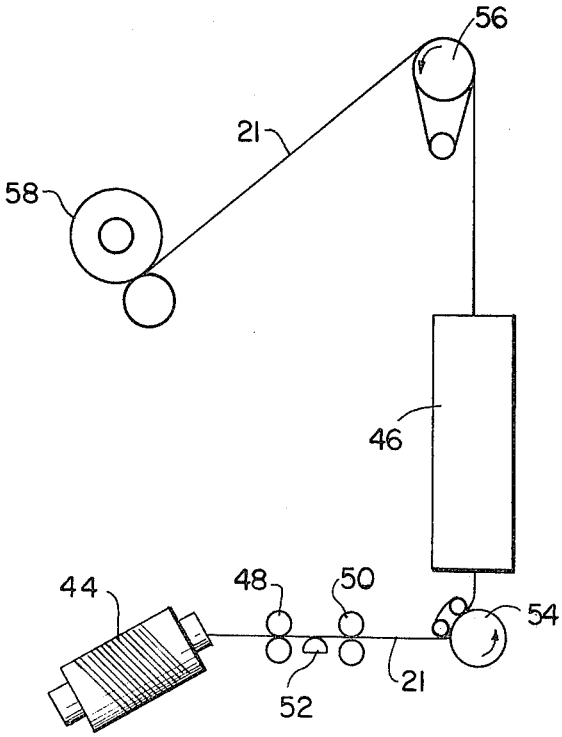
FIG. 3 is a side elevational view of the apparatus used to heat the fiber under tension.

The drawn, solid monofilaments are then subsequently heated to a temperature above about 100° F. but below their melting point to heat set the fibers so as to increase their shrink resistance. As shown in FIG. 3, fibers 21 from spool 44 first pass through a pair of draw rolls 48 and 50 which pull the fiber over a pre-heater 52 and feed the fiber into the nip of an input feed roll assembly 54. The fibers pass through the heater 46 and over a feed roll 56 to the takeup spool 58. When the fibers comprise a copolymer of ethylene and vinyl acetate, the preferred heater temperature is in the range of about 150° to 200° F. The tension on fibers 21 as they pass through the heater 46 is sufficient to prevent them from shrinking. Fibers 21, however, are not stretched so their diameter remains unchanged through the heating step.

In one embodiment, the bundle of fiber strands is twisted together to form a yarn prior to heat setting. In another embodiment, the fibers may be heat set at a later stage as during a yarn bulking step. For example, if yarn bulking were accomplished by use of the knit-deknitting process, heat setting may be accomplished by heating the knitted sock under tension.

To improve the heat resistance of the fiber, it is preferred to partially cross-link the molecules of the polymeric material. This may be achieved by mixing a free radical former such as peroxide, e.g., ditertiary butyl peroxide with the polymeric material and then adding a monomer having at least two vinyl groups as the cross-linking agent such as for example, divinyl benzene, trivinyl benzene, diallyl phthalate, triallyl cyanurate, etc. Cross-linking polyethylene or ethylene-vinyl acetate copolymers is well known and is illustrated by British Pat. No. 853,640 for example, which lists many peroxy activators and cross-linking monomers. Peroxides alone are known cross-linkers for the polyethylenes. A vinyl silane grafted on the polyethylene chain by a peroxide may serve as a cross-linking mechanism.

Most preferably, cross-linking is achieved by irradiating the fiber with an electron beam either as yarn or in fabric or product form. The dosage of radiation should be sufficient to cross-link the molecules to the extent that they have a gel content greater than 30% but less than 90%. The preferred gel content is 45–55%. Gel content of the ethylene-vinyl acetate fiber may be determined by a solvent extraction using hot xylene.

In accordance with our invention, the polymeric material may be partially cross-linked prior to heat setting the drawn solid monofilament. This permits the fiber to be heat set at higher temperatures, and therefore, further increases its shrink resistance. Preferably, in the first cross-linking step the polymeric material is cross-linked to the extent that the gel content is no greater than about 15%, and in the second cross-linking step the polymeric material is partially cross-linked to the extent that the gel content is no greater than 90%.

To enhance radiation cross-linking, there may be distributed throughout the polymeric material fine particles of silicon dioxide or titanium dioxide. The particle size of these oxides range between 100 angstroms and 1 micron and the amount used is below 1 volume percent. This small amount of oxide improves the efficiency of the irradiation step. For example, a polymeric material irradiated at a dosage of 10 megarads (MR) will have a gel content of 25–28%. When this same polymer includes 0.2 volume percent silicon dioxide and is irradiated at the same dosage, the gel content is 40–45%. This increase in gel content represents a substantial increase in the melting point of the polymeric material. Also the addition of poly-functional monomers improves cross-linking. For example, triallyl cyanurate or allyl acylate, alone or in combination with the oxides, are additives which enhance the cross-linking yield for a given radiation dosage.

It is also possible and usually desirable to include in the fiber very finely divided coloring agents and solid fillers as well as well-known and available flame retardants, antistatic agents, or antisoiling agents. Anti-oxidants and stabilizers may likewise be added, such as for example, unsaturated benzophenone derivatives described in U.S. Pat. No. 3,214,492, N-N′ dinapthyl p-phenylene diamine, or Irganox 1010, a multi-functional anti-oxidant having four sterically hindered phenolic groups, available from Ciba-Geigy. Because of the low melting point of the polymers used in the manufacture of our fabric, we can also use additives, especially dyes, flame retardants, antistatic agents and antisoiling agents which are sensitive to, or degrade at, temperatures necessary to process nylon fiber.

Figure 4:
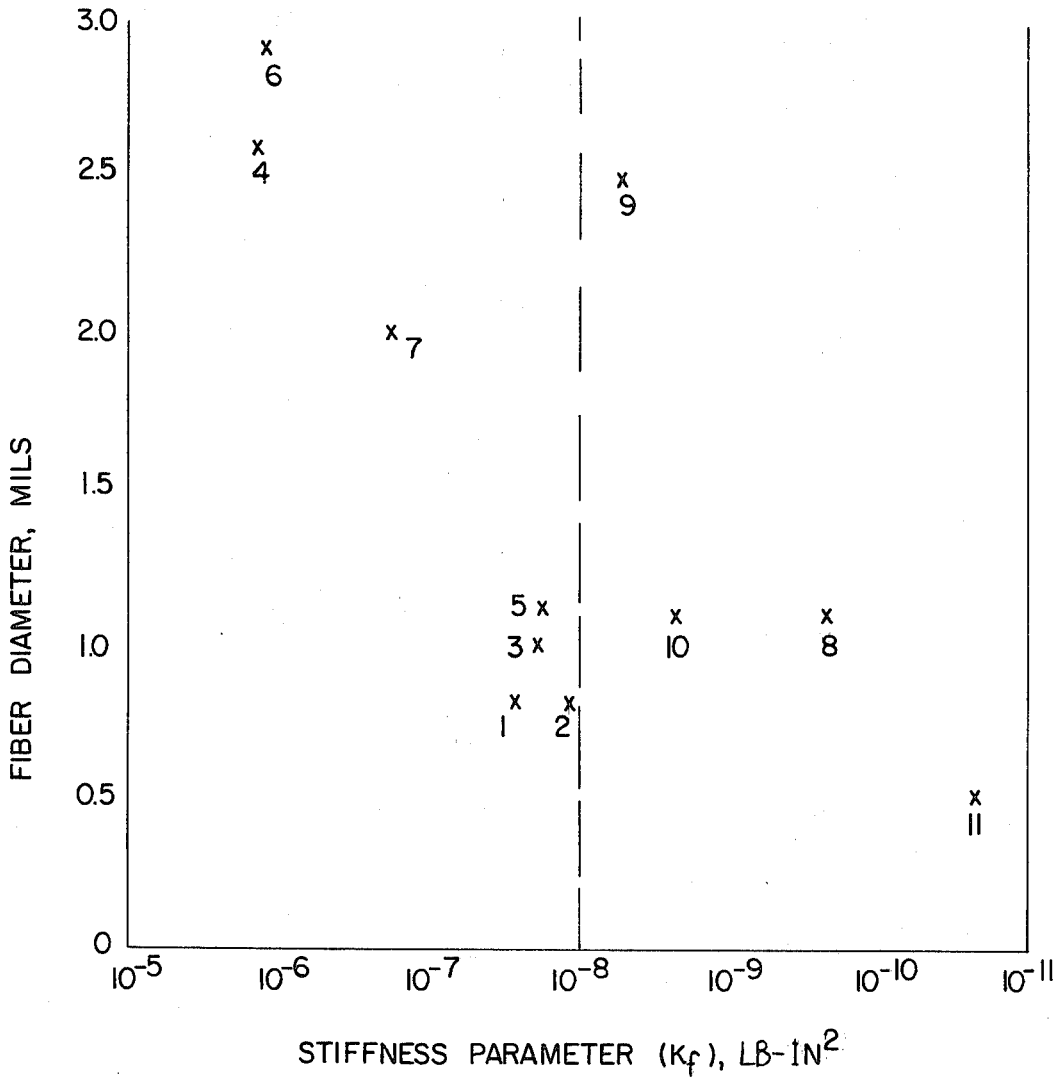
FIG. 4 plots fiber diameter against stiffness parameter for exemplary natural and man-made fibers as compared to the fibers of this invention.

Turning now to FIG. 4, there is shown a plot of fiber diameter against the stiffness parameter for a number of different fibers. The plotted data is identified in the following table.

TABLE

| Graph Point | Fiber | Elastic Modulus (psi) |
|---|---|---|
| 1 | Cotton | 2,100,000 |
| 2 | Wool, fine | 520,000 |
| 3 | Nylon 6, monofilament, 5 denier | 375,000 |
| 4 | Nylon 6, monofilament, 35 denier | 375,000 |
| 5 | Polypropylene, monofilament, 5 denier | 210,000 |
| 6 | Polypropylene, monofilament, 35 denier | 210,000 |
| 7 | Polypropylene, monofilament, 2 mil | 210,000 |
| 8 | Ethylene-vinyl acetate, monofilament, 5 denier | 5,000 |
| 9 | Ethylene-vinyl acetate, monofilament, 35 denier | 5,000 |
| 10 | Ethylene-vinyl acetate, monofilament, 5 denier | 50,000 |
| 11 | Ethylene-vinyl acetate, monofilament, 0.5 mil | 5,000 |

As can be seen from the plotted data, cotton and fine wool have a stiffness parameter approaching $10^8$ lb-in$^2$. Fabrics made from the fibers as by knitting or weaving have a soft, fine feel or hand. Conversely, fabrics made from relatively large (2.5–3 mil) nylon or polypropylene fibers, represented by data points 4 and 6, display a more harsh, hard feel or hand.

Data points 8 through 11 represent typical fibers of our invention. Even relatively large (2.5 mil) fibers of low modulus polymer display a stiffness parameter less than that of cotton or fine wool as is shown by data point 9. Fabrics made of such fibers display the soft feel or hand of fine wool even though the fibers are far coarser. Fabrics made of smaller diameter fibers of low modulus polymer, as represented by data points 8 and 11, display a remarkable degree of softness as compared to even fine wool goods. As may be appreciated from the Figure, the smaller diameter, low modulus fibers of our invention display a stiffness parameter two to three orders of magnitude less than that of the traditionally soft fibers of the prior art.

Our fibers may be twisted or spun into yarn and thereafter formed into fabrics by conventional weaving and knitting techniques. The yarn preferably comprises from about 15 to 50 single fibers twisted together with about 0.5 to 2 twists per linear inch. Bulking of the yarn may be accomplished using conventional techniques such as knitting-deknitting and the like.

Woven or knitted fabrics made from our fibers display an exceptional degree of softness and may be used for garments and the like. A long-pile fabric simulating a very fine animal fur may be produced by tufting yarn through a backing material. When a fabric is made by tufting, we prefer that the elastic modulus of the polymeric fiber exceed 5,000 psi as fibers with a lower elastic modulus tend to be too elastic for proper tufting.

We claim:

1. A monofilament fiber of polymeric material characterized by:

(a) an elastic modulus of from 2,000 to 100,000 psi, (b) a fiber diameter in the range of about 0.5 to 3 mils, and (c) a stiffness parameter less than $8.5\times10^{-9}$ lb-in$^2$.

2. The fiber of claim 1, wherein the polymeric material is thermoplastic.

3. The fiber of claim 2 where the thermoplastic is (a) plasticized polyvinyl chloride, (b) low density polyethylene, (c) ethylene-ethyl acrylate copolymer, (d) ethylene-butylene copolymer, (e) polybutylene and copolymers thereof, (f) ethylene-propylene copolymers, (g) chlorinated polypropylene, (h) chlorinated polybutylene, or (i) mixtures of these thermoplastics.

4. The fiber of claim 3 having dispersed therein one or more additives of the group consisting of colorants, fillers, flame retardants, antistatic agents and antisoiling agents.

5. The fiber of claim 4 wherein said thermoplastic is partially cross-linked.

6. The fiber of claim 5 wherein said fibers are partially cross-linked by irradiation and wherein at least one of said additives acts to enhance the radiation cross-linking thereof.

7. The fiber of claim 6 wherein said cross-linking enhancing additive is selected from the group consisting of silicon dioxide, titanium dioxide and trially cyanurate.

8. The fiber of claim 1 having a generally circular cross-section.

9. The fiber of claim 1 wherein said polymeric material comprises an ethylene-vinyl acetate copolymer having a vinyl acetate content of 1 to 20 percent and a melt index in the range of 0.5 to 9.

10. The fiber of claim 9 wherein said ethylene-vinyl acetate copolymer is partially cross-linked.

11. The fiber of claim 10 wherein cross-linking is accomplished by incorporating into the polymer a peroxy activator and a cross-linking agent.

12. The fiber of claim 10 wherein cross-linking is accomplished by irradiation.

13. The fiber of claim 12 wherein an additive selected from the group consisting of silicon dioxide, titanium dioxide, triallyl cyanurate and mixtures thereof is dispersed therein, said additive acting to enhance the radiation cross-linking of said copolymer.

14. The fiber of claim 13 cross-linked to the extent of having a gel content greater than 30% but less than 90%.

15. The fiber of claim 10 having dispersed therein one or more additives of the group consisting of colorants, fillers, flame retardants, antistatic agents and antisoiling agents.

16. The fiber of claim 9 having a generally circular cross-section.

17. The fiber of claim 9 wherein the ethylene-vinyl acetate copolymer has an elastic modulus in the range of 5,000 to 50,000 psi.

18. Yarn comprising a continuous strand of multiple monofilament fibers of a polymeric material characterized by:

(a) an elastic modulus of from 2,000 to 100,000 psi, (b) a fiber diameter in the range of about 0.5 to 3 mils, and (c) a stiffness parameter less than $8.5\times10^{-9}$ lb-in$^2$.

19. The yarn of claim 18 containing 15 to 50 fibers, said fibers twisted together and bulked.

20. The yarn of claim 19 having from 0.5 to 2.0 twists per linear inch.

21. The yarn of claim 18 wherein each fiber has a generally circular cross-section.

22. A fabric comprising yarn consisting of polymeric, thermoplastic, monofilament fibers and characterized by:

(a) an elastic modulus of said thermoplastic ranging from 2,000 to 100,000 psi, (b) a fiber diameter ranging from about 0.5 to 3 mils, and (c) a fiber stiffness parameter less than $8.5\times10^{-9}$ lb-in$^2$.

23. The fabric of claim 22 wherein said fibers comprise an ethylene-vinyl acetate copolymer having a vinyl acetate content ranging from 1 to 10 percent by weight.

24. The fabric of claim 23 wherein said ethylene-vinyl acetate is partially cross-linked.

25. The fabric of claim 24 wherein the fabric is formed by knitting.

26. The fabric of claim 24 wherein the fabric is formed by weaving.

27. The fabric of claim 24 having a long pile simulating a soft animal fur.

* * * * *